US006453487B1

(12) United States Patent
Babington

(10) Patent No.: US 6,453,487 B1
(45) Date of Patent: Sep. 24, 2002

(54) PORTABLE FIELD SANITATION UNIT

(76) Inventor: Robert S. Babington, 1113 Ingleside Ave., McLean, VA (US) 22101

( * ) Notice: Subject to any disclaimer, the term of this patent is extended or adjusted under 35 U.S.C. 154(b) by 0 days.

(21) Appl. No.: 09/908,811

(22) Filed: Jul. 20, 2001

(51) Int. Cl.[7] ..... A47K 1/04
(52) U.S. Cl. ..... 4/619; 4/638; 4/545; 126/33
(58) Field of Search ..... 4/545, 619, 638, 4/639, 640, 654; 126/33

(56) References Cited

U.S. PATENT DOCUMENTS 2,563,253 A * 8/1951 Levin ..... 126/33
2,594,938 A * 4/1952 Leavitt ..... 4/638
4,747,169 A * 5/1988 Valbuena ..... 4/625
4,856,579 A * 8/1989 Wolfe ..... 126/33 X
5,975,071 A * 11/1999 Babington ..... 126/33
6,101,643 A * 8/2000 Moore ..... 4/638 X

* cited by examiner

*Primary Examiner*—Charles E. Phillips
(74) *Attorney, Agent, or Firm*—Connolly Bove Lodge & Hutz LLP

(57) ABSTRACT

A field sanitation unit provides multiple compartments forming separate sinks. The multiple compartments are heated via a channel located on the underside of the trough, having at one end thereof a firebox. The firebox receives a flame tube from a burner, and supplies hot gases through the firebox to a channel running the length of the trough. By providing baffles within the channel, it is possible to redirect the hot gases laterally, thereby controlling the temperature of each sink.

14 Claims, 7 Drawing Sheets

PORTABLE FIELD SANITATION UNIT

FIELD OF THE INVENTION

The present invention relates to systems for field feeding large numbers of people where portable sanitation facilities are necessary. Specifically, a field sanitation unit providing multiple sinks with different bath temperatures is disclosed.

In applications such as are used in the military, or in emergency disaster feeding operations, it is necessary to establish a complete kitchen in the field in locations remote from any permanent facilities. The remote kitchen must have appliances which will operate on available fuel, such as diesel, for cooking food and for cleaning utensils. Typically, the field feeding clean up operations require the availability of multiple sinks having water at different temperatures. In one prior art technique, a steam tube is inserted in a compartment of water and exiting steam heats the water to a temperature so that it may be useful in washing dishes and other kitchen utensils.

In one conventional feeding system, manufactured by Babington Enterprises, Inc., cooking is performed using a tray ration heater. In these systems, a Babington Airtronic burner is utilized to heat or boil 30 gallons of water which is available for cooking sealed tray rations. The Airtronic burner is unique in that it is capable of operating from various fuel sources, and is specifically useful in portable field operations where diesel fuel is available. The Airtronic burner has additionally been utilized in the military M59 heating unit, where it is useful for providing stove top cooking operations.

The complete portable field feeding units require appropriate sanitation equipment for cleaning pots, pans, utensils and dishes. This requires that washing sinks be provided having different water temperatures, where the normal wash cycle includes washing at a temperature of 90–105°, rinsing at a temperature of 120–140°, and sanitizing in a bath of hot water above 170°.

The present invention is directed to providing such field sanitation services utilizing the Babington Airtronic multi-fuel burner.

SUMMARY OF THE INVENTION

A field sanitation unit is disclosed for providing multiple sinks of hot water at different temperatures. A metal trough is divided into three separate compartments forming separate sinks. The metal trough is supported above ground with a firebox located at one end thereof. The firebox has an outlet directed along the underside of the trough. A channel is connected with the firebox outlet, and runs along the underside of the trough. Various baffles are located along the channel to divert hot gases laterally within the channel thereby controlling the temperature below each of the sinks. A flame tube of a burner is inserted in the firebox and hot gases are directed along the bottom of the metal trough. The sink compartment closest to the burner is heated to a higher temperature than the remaining two sink compartments, while the more distant sink compartment is maintained at a significantly cooler temperature.

DESCRIPTION OF THE PREFERRED EMBODIMENT

Figure 1:
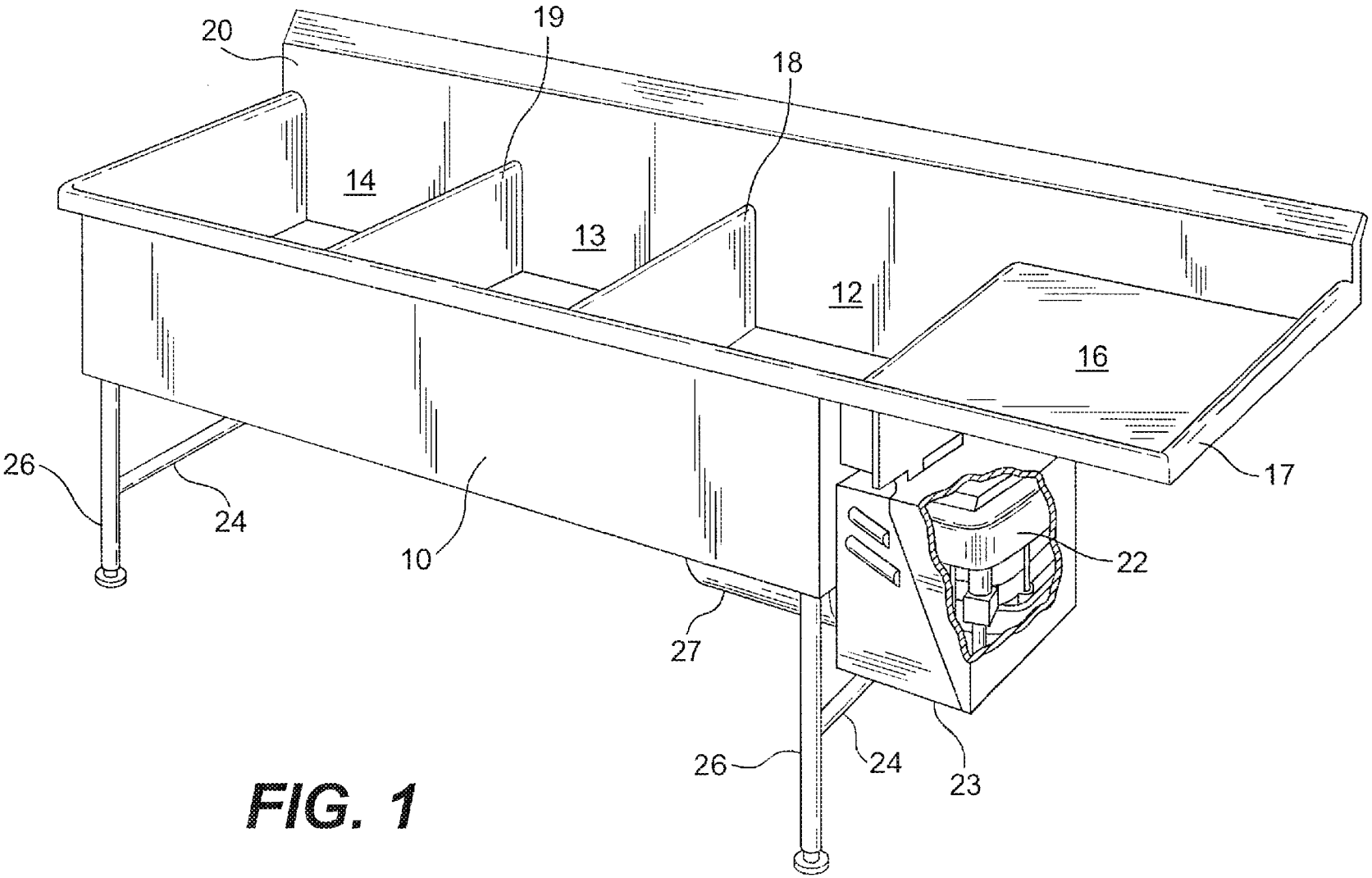
FIG. 1 is a perspective view of a field sanitation unit in accordance with a preferred embodiment.

Referring now to the perspective view of FIG. 1, a field sanitation unit in accordance with the preferred embodiment of the invention is illustrated. The field sanitation unit includes an elongated trough 10, forming three separate sink compartments 12, 13, and 14 located along a common axis. Each of the sink compartments holds a quantity of washing water, and can be heated to a different temperature. Thus, in a conventional field feeding operation, pots, pans, utensils and dishes may be initially washed in the lower temperature sink water 14, then rinsed in the higher temperature sink water compartment 13, and finally sanitized in the hottest temperature water in sink compartment 12. A relative difference in temperature is maintained in each of the sink compartments as will be evident from the following discussion.

The entire elongated trough 10 can be of stainless steel as is conventional in kitchen appliances. The stainless steel compartment 10 has a back splash 20, which is higher than the front edge of the trough. The edges 17 of the sink are rolled as is conventional for stainless steel kitchen appliances. Also shown in the field sanitation unit is a drain board or workstation 16 where items being cleaned may be allowed to drain or stacked for later storage. A second drain board may be located on the other end of the sanitation unit, and a rolled edge may completely surround the sinks in cases where a back splash (to accommodate faucets) is not desired. The field sanitation unit is supported above ground by a plurality of legs 26 interconnected by braces 24, so that the sinks 12, 13, 14 have a standard height vis-à-vis personnel washing utensils.

The field sanitation unit is heated with a multi-fuel burner 22, such as the Babington Airtronic burner. The burner produces a source of heating gases in a firebox 27. The heating gases are conveyed through a channel along the bottom of the trough 10 so that the bottom of each sink compartment 12, 13, 14 may be heated to the appropriate temperature for field washing.

Figure 2:
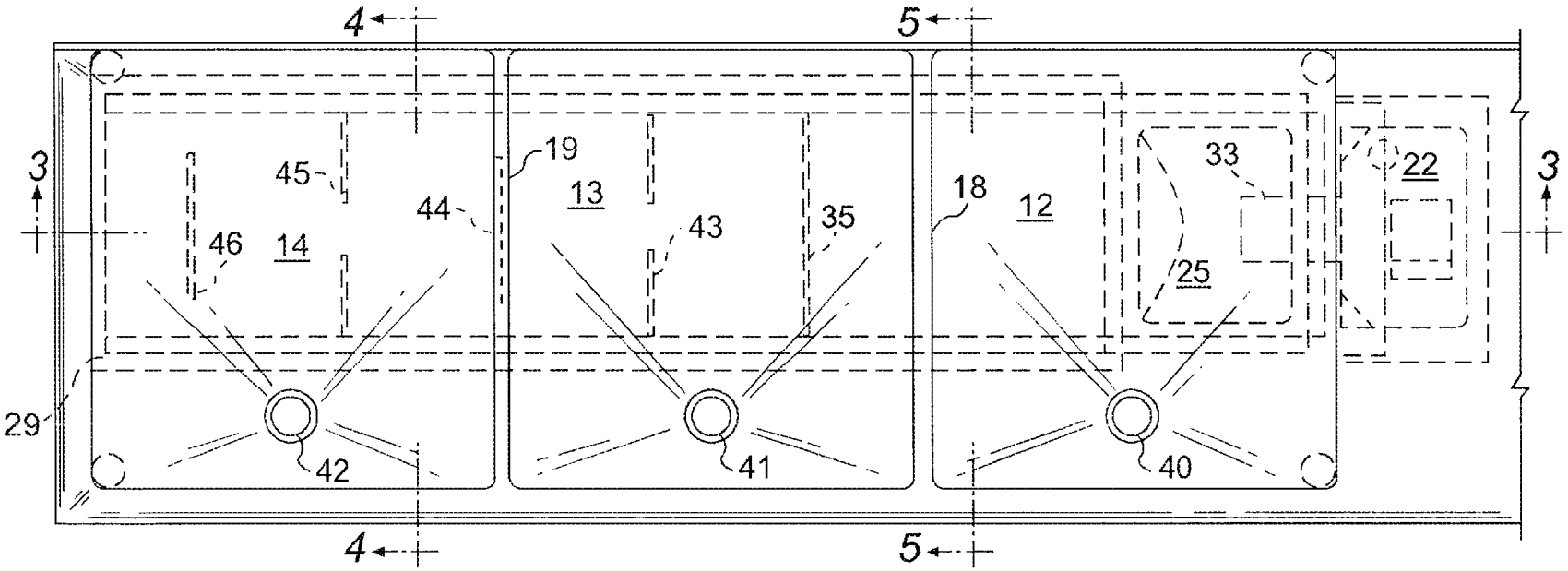
FIG. 2 is a top view of the field sanitation unit of FIG. 1.
Figure 3:
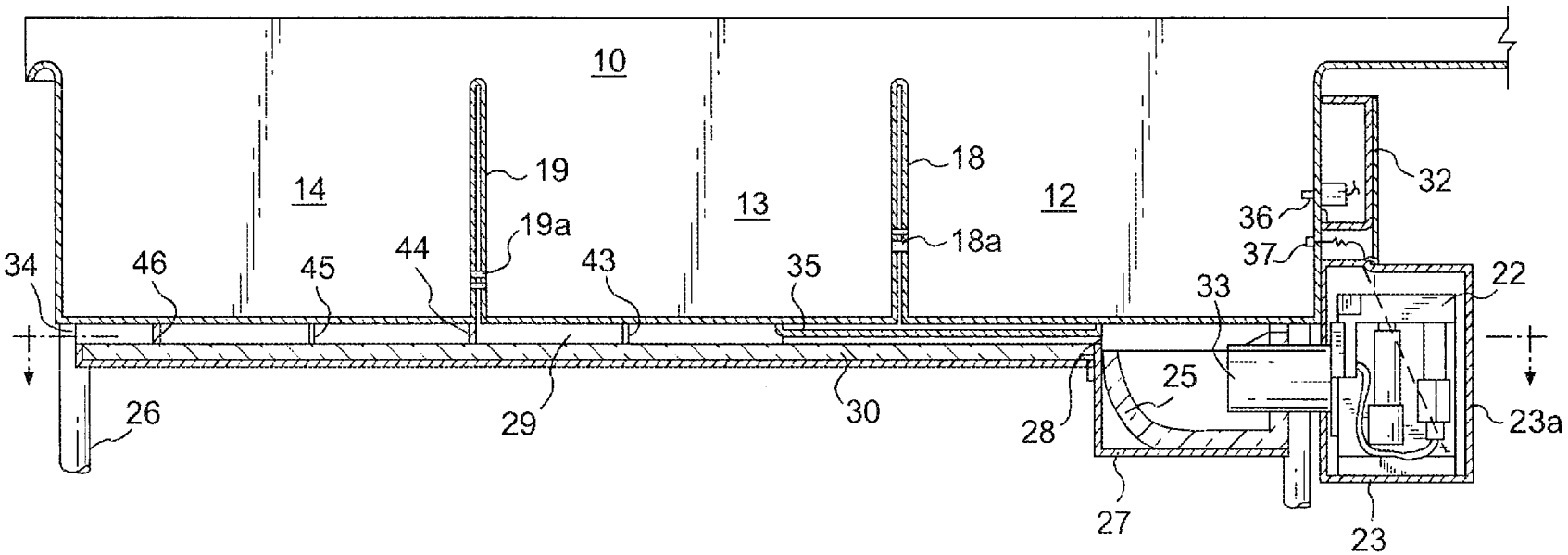
FIG. 3 is a lateral section view of the field sanitation unit.

FIGS. 2 and 3 show a top view and a lateral section view of the field sanitation unit. Each of the sink compartments has its own drain 40, 41, 42. Sinks 12 and 13 are separated by a wall 18 of the same stainless steel material as the trough 10, and sinks 13 and 14 are separated by a wall 19 also of stainless steel.

As the lateral section view of FIG. 3 illustrates, the burner 22 is supported within a weather-tight housing 23 at one end of the trough 10 having a hinged lid 23*a*. A burner tube 33 introduces a flame into the firebox 27 which is lined with a refractory material 25. Firebox 27 has an open top exposing the bottom of sink 12 to direct heat from the burner tube 33. An opening 28 in the firebox conveys hot gases produced from the flame along a heat channel 29 which extends along the underside of the trough 10 to an exhaust opening 34. The opening 28 may comprise a series of openings across the front of the firebox forming a heat discharge surface. Multiple openings provide a back pressure within firebox 27 insuring an even distribution of hot gases across the width of channel 29.

The channel 29 contains a refractory material 30 along the length thereof. A baffle 35 is shown comprising a high temperature stainless steel surface spaced apart from the bottom of sink compartment 12. The baffle 35 insulates the bottom of sink compartment 12 from the heat channel 29, so that excessive heat is not directed to the bottom of compartment 12 thereby burning through the bottom of compartment 12.

Additionally, baffles 43, 44, 45, and 46 are located along the heat channel 29 to laterally deflect hot gases which are directed from the firebox outlet 28. By selection and placement of the baffles as shown, it is possible to laterally displace the hot gasses and establish a heat distribution along the underside of the trough 10 to maintain the appropriate temperature relationship between each of the baths contained in sinks 12, 13, and 14.

A thermal couple 37, or other type of temperature sensor, is supported on the wall of the sink 12. The hottest temperature achieved by any of the sinks 12, 13, and 14 is regulated by enabling and disabling burner 22 in accordance with the signal from thermal couple 37. Thus, it is possible using a thermostat control on the burner 22 to maintain the hottest bath temperature in sink 12 at a fairly constant level. The sink 12 has a water level detector 31 which disables the burner if sink 12 has an insufficient water level. Sink 12 has an opening 18*a* which permits a flow of water into sink 13. Sink 13 in turn has an opening 19*a* which permits a flow of water into sink 14. The openings 18*a* and 19*a* insure a minimum water level in each of the sinks before heat is applied to trough 10. Once the water level reaches water level detector 36, the burner will be enabled to heat the system. If it is necessary to provide one way flow through openings 18*a* and 19*a,* to keep contaminants from flowing between sinks 14 and 13 into sink 12, check valves may be inserted into openings 18*a* and 19*a*.

Maintaining the water temperature of the sink 12 at a constant level also fixes the temperature of the water in sinks 13 and 14. As the heat escapes through the heat channel 29, the gases become cooler and a temperature differential is established between the water in each of the sinks 12, 13, and 14. The process of establishing different temperatures for each sink 12, 13, and 14 is aided by the baffles 43, 44, 45,and 46, as will be evident from the following.

Figure 4:
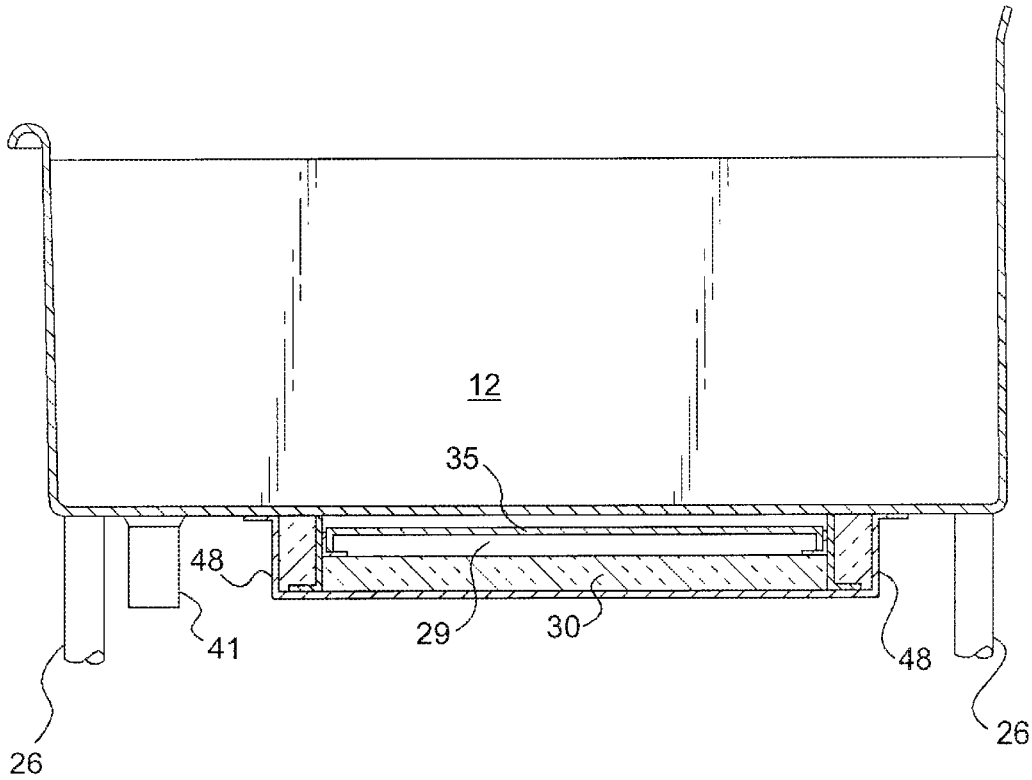
FIG. 4 is a mid section view of the field sanitation unit.

FIG. 4 illustrates a mid section view showing the baffle 35 providing an air channel between the bottom of sink 12 and the surface of the insulation 30 of channel 29. The channel 29 includes first and second sidewalls 48 which run the length of the trough having insulation 30 to reduce the heat transfer through the channel sides.

Figure 5:
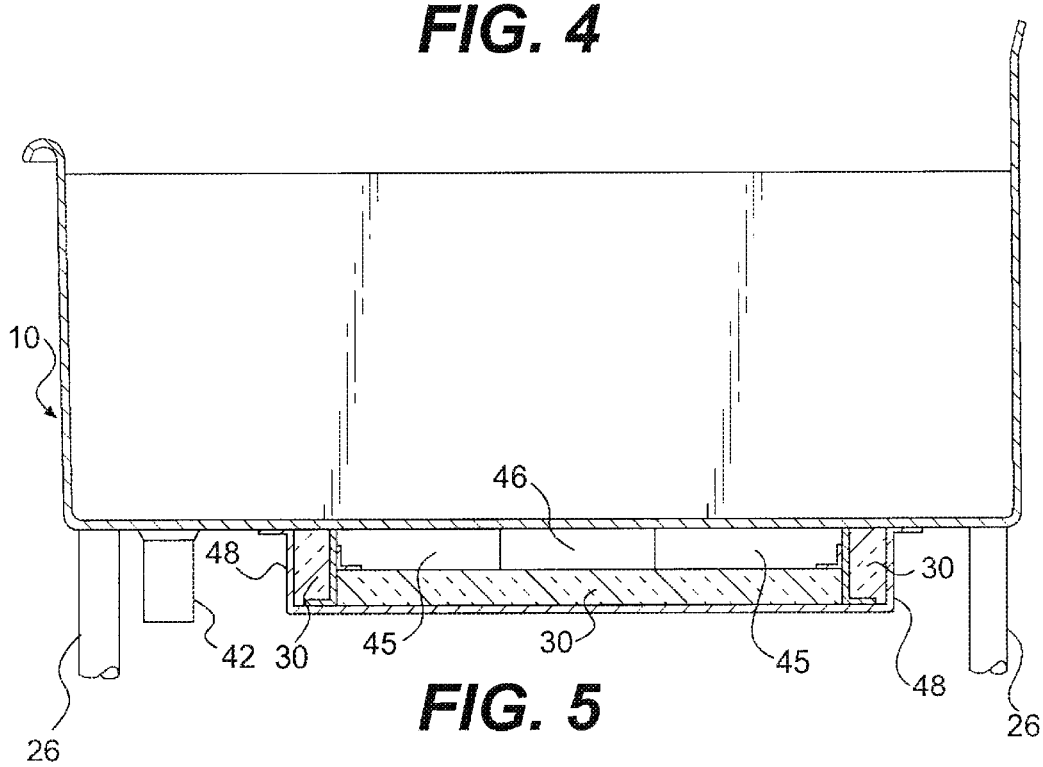
FIG. 5 is a end section view of the field sanitation unit.
Figure 6:
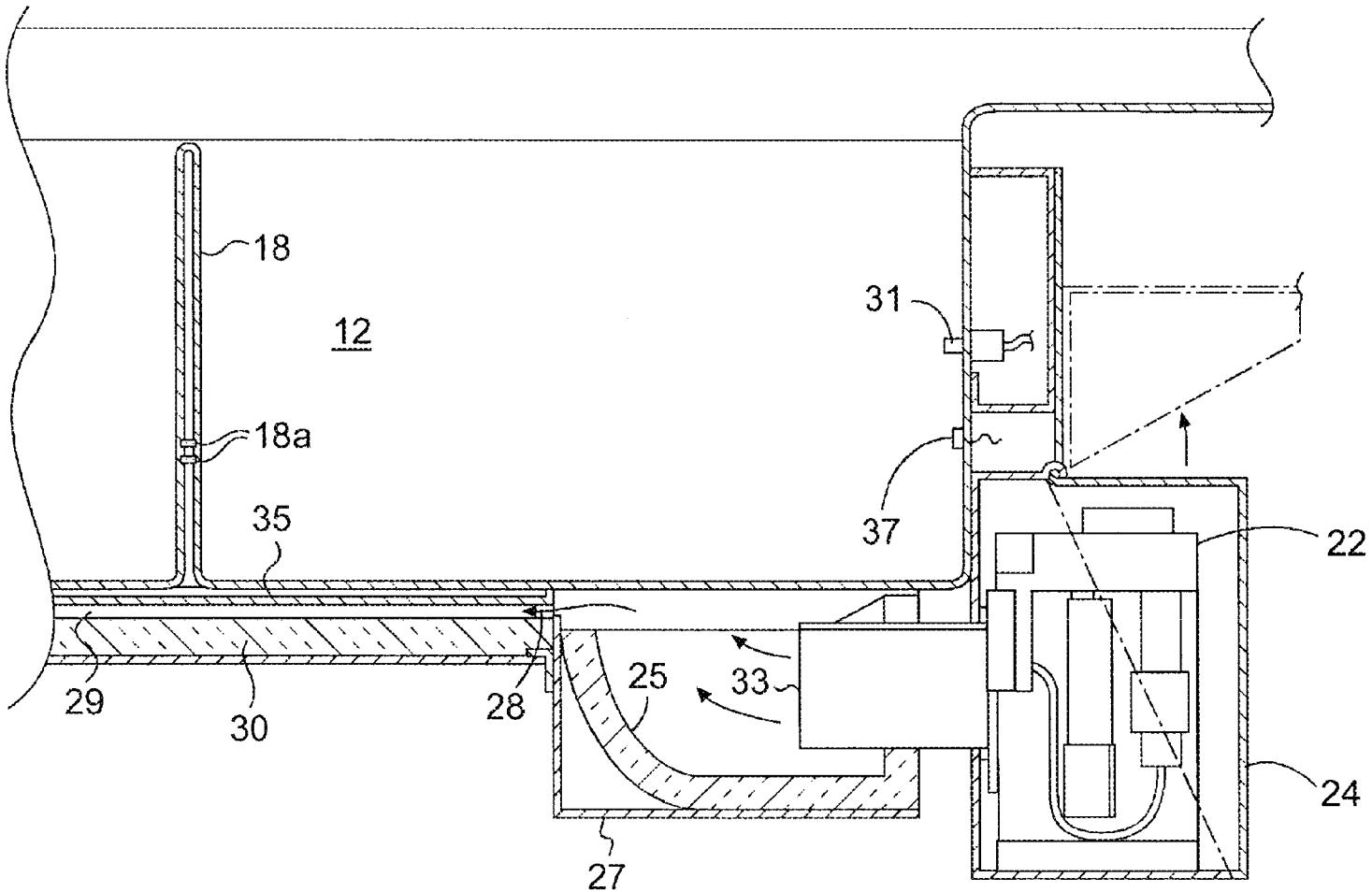
FIG. 6 shows in greater detail a lateral section view of the firebox and heat channel configuration.
Figure 7:
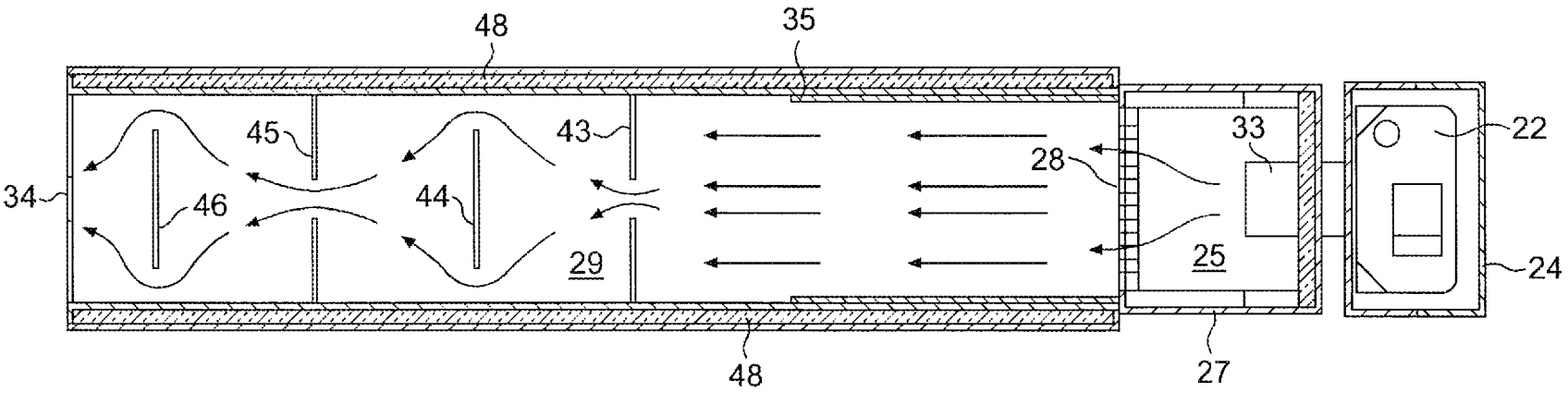
FIG. 7 is a top view illustrating a typical heat flow through the heat channel.

FIG. 5 shows an end view of the heat channel 29, wherein each of baffles 45 and 46 are shown. The effects of the baffling within the heat channel 29 is more completely described with respect to FIGS. 6 and 7. As shown in FIG. 6, the heat from the flame tube 33 exits the opening 28 in the firebox 27. The heat, in accordance with FIG. 7, is conveyed through channel 29 along the underside of baffle 35 of sink 12. It is laterally deflected towards the center of the channel 29 by a first baffle 43 having a centrally located opening for permitting the hot gases to enter the portion of the heat channel 29 below sink 13. A baffle 44 diverts the heat laterally towards the outside walls 48 of the channel 29. A second set of baffles 45 and 46 provide a similar change in direction for the heat being conveyed as hot gasses through the channel 29. By laterally changing the flow of heat through the channel 29, it is possible to change the respective temperatures of the water contained in sinks 13 and 14.

Figure 8:
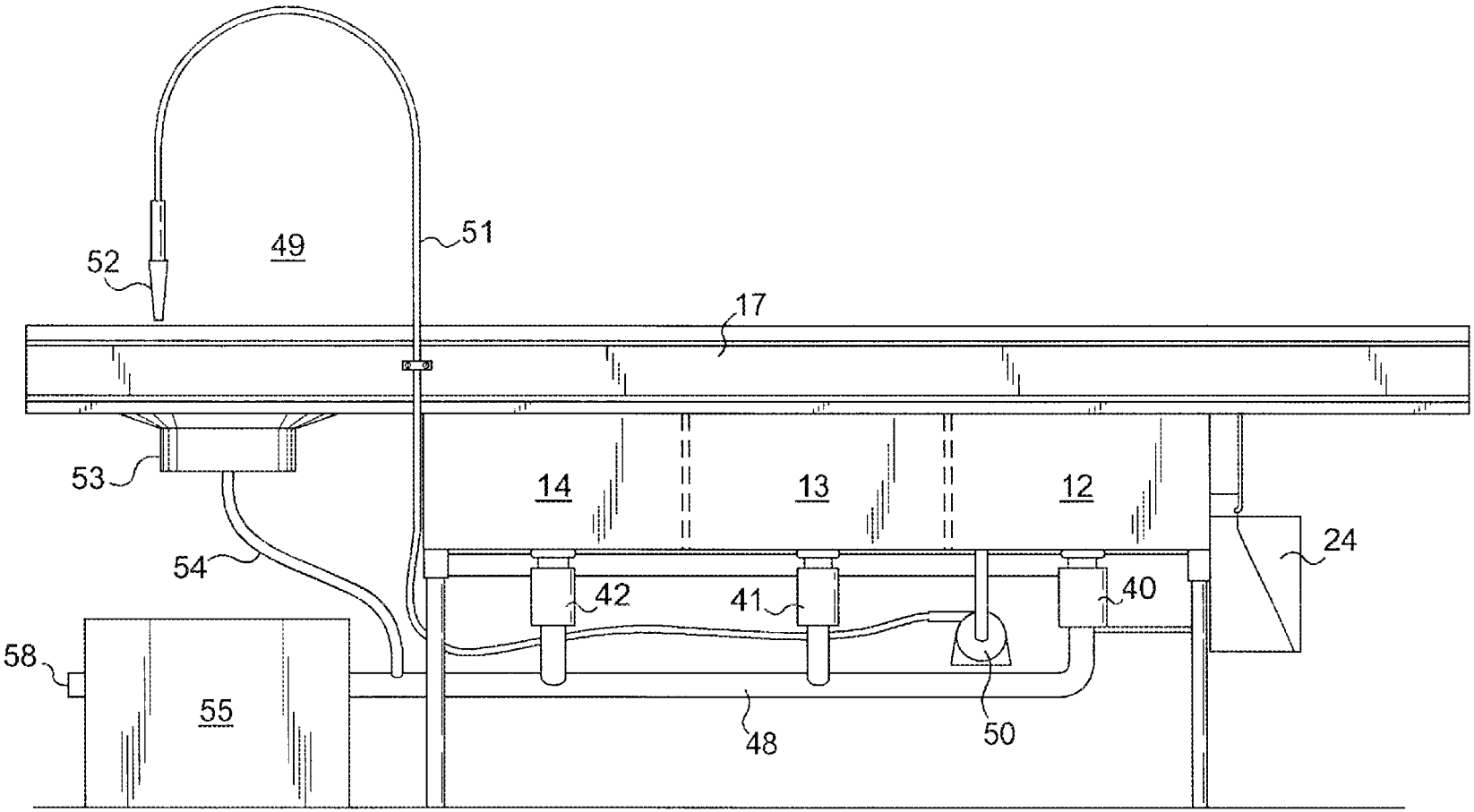
FIG. 8 is a plan view of a second embodiment of the invention having a prewash station having a grease separation unit.

FIG. 8 shows a second embodiment of the invention. As with the first embodiment of the invention, a longitudinal trough 10 is partitioned to provide sinks 12, 13, and 14 (like numbers illustrate like components between embodiments). Additionally, there is a hot water prewash station 49 attached to one end of the field sanitation unit. The prewash station includes a source of pressurized water through nozzle 52, which can be hand operated by the user. The pressurized water is supplied via a conduit 51 connected to pump 50 which draws hot water from sink 12. The outlet for the prewash station 49 is connected to a drain 53, and conveyed through a hose or other conduit 54 to a grease separation unit 55, which is a commercially available grease separation unit. Outlets for each of the sinks 12, 13, and 14 are also connected together via a water disposal pipe 48, and connected to the grease separation unit 55, which is a commercially available grease separation unit. Treated water is drained through outlet 58 of grease separation unit 55. This allows gray water devoid of grease to be discharged in accordance with local sanitation codes. Thus, the second embodiment of the invention in accordance with FIG. 8 permits a further adaptation of the basic configuration of multiple sinks having different temperature baths for providing field sanitation facilities.

The foregoing description of the invention illustrates and describes the present invention. Additionally, the disclosure shows and describes only the preferred embodiments of the invention, but it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A field sanitation unit comprising:

a plurality of sinks disposed along a common axis, said sinks including a plurality of drains;

an insulated fire box disposed adjacent to one end of said plurality of sinks, said fire box having an opening to receive a burner nozzle, and open at an opposite end to discharge hot gases along said axis;

a hot exhaust gas channel formed below said plurality of sinks, said channel including a number of baffles to direct heat from said firebox along the bottom of said sinks, said baffles; arranged so that the temperature of each sink with respect to the remaining sinks are maintained at a respective level; and a burner supported at said one end of said plurality of sinks so that said nozzle extends into said firebox, wherein fire is introduced into said fire box generating heat for maintaining said sinks at a respective temperature.

2. The field sanitation unit according to claim 1 wherein said baffles comprise:

a first set of baffles which form a centrally located opening in said channel; and a second set of baffles for directing hot gases flowing through said channel to the lateral walls of said channel.

3. The field sanitation unit according to claim 2 wherein said baffles are below sinks which are furthest from said fire box.

4. The field sanitation unit according to claim 1 further comprising a prewash station supported adjacent said sinks.

5. The field sanitation unit according to claim 1 wherein said sink closest to said fire box is insulated from said channel to maintain the temperature of said first sink at a predetermined level.

6. The field sanitation unit according to claim 1 further comprising a water level detector which disables said burner if the water level in one of said sinks is below a predetermined level.

7. The field sanitation unit according to claim 6, wherein each of said sinks are connected together through openings in walls which separate said sinks so that a minimum amount of water is provided in all of said sinks when said burner is enabled.

8. The field sanitation unit according to claim 6 further comprising a prewash station affixed to one end of said unit, said prewash station having a supply of cleansing water and a disposal for collecting waste water.

9. The field sanitation unit according to claim 8 wherein said supply of cleansing water comprises a pump for drawing water from one of said sinks.

10. The field sanitation unit according to claim 1 further comprising a temperature sensor in thermal contact with one of said sinks for providing a control signal for enabling and disabling said burner.

11. A field sanitation unit comprising:

a metal trough divided into three separate compartments forming separate sinks;

a structure for supporting said trough above ground;

a fire box mounted at one end of the trough, said fire box having an outlet directed along the underside of said trough;

a channel communicating with said outlet and running the length of said trough, said channel including a series of baffles for directing hot gasses from said channel laterally thereby altering the temperature profile along the bottom of said trough; and a burner having a flame tube extending into said fire box, said burner supplying said hot gasses to said firebox which are directed to the underside of said trough heating each of said compartments to a different temperature.

12. The field sanitation unit according to claim 11 wherein said baffles alternately divert the direction of hot gasses in said channel.

13. The field sanitation unit according to claim 11 further comprising an insulating structure on the underside of a compartment adjacent said firebox for keeping the compartment from overheating.

14. The field sanitation unit according to claim 11 wherein each of said compartments has its own drain.

* * * * *